US006749189B1

(12) United States Patent
Wolff et al.

(10) Patent No.: US 6,749,189 B1
(45) Date of Patent: Jun. 15, 2004

(54) WORKBENCH

(75) Inventors: Friedrich Wolff, Bad Neuenahr (DE); Zbigniew Noniewicz, Kempenich (DE)

(73) Assignee: wolfcraft, GmbH., Kempenich (DE)

( * ) Notice: Subject to any disclaimer, the term of this patent is extended or adjusted under 35 U.S.C. 154(b) by 0 days.

(21) Appl. No.: 09/914,903

(22) PCT Filed: Mar. 3, 2000

(86) PCT No.: PCT/EP00/01857

§ 371 (c)(1),
(2), (4) Date: Dec. 31, 2001

(87) PCT Pub. No.: WO00/53375

PCT Pub. Date: Sep. 14, 2000

(30) Foreign Application Priority Data

Mar. 5, 1999 (DE) ..... 199 09 830

(51) Int. Cl.[7] ..... B25B 1/02
(52) U.S. Cl. ..... 269/139; 269/16
(58) Field of Search ..... 269/139, 16, 3, 269/281 R

(56) References Cited

U.S. PATENT DOCUMENTS 4,127,260 A * 11/1978 Hickman ..... 269/139
4,154,435 A * 5/1979 Alessio ..... 269/139
4,159,821 A * 7/1979 Hickman ..... 269/139
4,276,955 A 7/1981 Hickman
4,527,786 A * 7/1985 Hsu ..... 269/154
5,065,989 A 11/1991 Ho
5,374,019 A 12/1994 Fischer
5,634,649 A 6/1997 Breining et al.
5,657,970 A * 8/1997 Davis ..... 269/16

FOREIGN PATENT DOCUMENTS

DE 27 49 381 A1 5/1979
DE 33 26 360 A1 2/1984
DE 43 24 628 A1 1/1995
FR 2 445 430 12/1979

* cited by examiner

*Primary Examiner*—Lee D. Wilson
(74) *Attorney, Agent, or Firm*—Bell, Boyd & Lloyd LLC

(57) ABSTRACT

A workbench (1) has a horizontal support (3) of a work component, especially in the form of clamping jaws (31, 32) or a work top, a foot part (4) and a support body (2) interlinking the foot part (4) and the work component support (3). The support body (2) that is mounted with its end (11) facing the foot close to the edge of the horizontally extending foot part (4) is mounted with its other end (16) diagonally juxtaposed close to the edge of the work component support (3).

14 Claims, 5 Drawing Sheets

36
3
35
2
1
4

WORKBENCH

BACKGROUND OF THE INVENTION

The invention relates to a workbench. More particularly, the present invention relates to a workbench having a horizontal work component support, particularly in the form of clamping jaws or a work top, a foot part, and a support body which connects the foot part and the work component support to each other.

These types of workbenches are known in a variety of embodiments. For space-saving storage, foldable workbenches are provided.

With respect to the above mentioned prior art, the technical problem of the invention is to develop a workbench which is advantageous over the described art.

SUMMARY OF THE INVENTION

This problem is principally solved by the subject matter of the workbench invention. An objective of the workbench is that the support body, the foot end of which is fixed close to the edge of the horizontally extending foot part, should be fixed with its other end diagonally juxtaposed close to the edge of the work component support. As a result of this configuration, the work component support, the support body, and the foot part form a z shape, wherein the support body forms the diagonal of the z. This produces a space-saving and simultaneously stable workbench, which has the shape of a standing desk.

In an advantageous development of the inventive subject matter, it is provided that the foot part and the work component support, which forms the legs of the z shape, are simultaneously foldable into a position parallel to the support body, which forms the diagonal of the z. This makes possible a space-efficient collapsing of the workbench, whereby handling is also user-friendly.

Pivoting the work component support from its horizontal operating position simultaneously causes a synchronized pivoting-in of the foot part in the direction of a position parallel to the support body. The fold-up path is limited when the legs hit the support body. Likewise, the unfolding path is also limited in that, in the unfolded position, the work component support and foot part extend horizontally parallel to one another. The synchronized folding motion of the legs, which occurs both in the folding and unfolding processes, is made possible by the additional coupling of the legs in the region of the support body, for example, with the aid of a coupling bar.

In another development, the folding motion of a leg is enabled by a first connecting rod which is led in a slot of the support body and which engages the foot part. Also, a second connecting rod engaging a support arm pivots at the support body, which is likewise guided in a slot of the support body synchronously with the first connecting rod. The pivoting displacement of a leg causes a linear displacement of a tab, which is guided in a slot of the support body, of the allocated connecting rod, given a simultaneous pivoting of the connecting rod about its axis, which is formed at the allocated leg. According to a preferred development, the two connecting rods are guided in the slots synchronously and are connected to each other. Thus, a connecting element which is disposed in the support body, for instance a coupling bar or the like, join the connecting rods, specifically their tabs or axles which protrude through the support body slots. As a result, an unfolding motion of the foot part leads to a linear displacement, in the allocated support body slot, of the free end of the first connecting rod which is rotationally mounted at the foot part, and to a synchronous linear displacement of the end of the second connecting rod, which is allocated to the support arm, as a consequence of which the support arm hinged at the support body unfolds in synchronized fashion.

In another embodiment of the invention, it is provided that, with the folding of the workbench, the end of the support arm opposite the joint at the support body slides along a guideway of the work component support. The guideway is adapted to the pivot path of the support arm in such a way that the pivoting of the support arm for an unfolding maneuver brings the work component support into the horizontal operating position. The guideway can be formed by an edge angle of the work component support. But, the guideway could be constructed as a guide slot which the support arm end engages.

It is also expedient when the unfolded final position, i.e. the horizontal position of the work component support, is stop-limited. An additional locking of the final positions, both in the unfolded and folded positions, also proves to be expedient.

It is thus proposed that the support body be constructed as a four-sided closed torsion-resistant box. Further, a space-efficient solution is achieved by a bipartite foot part, the two parts of which sit next to the support body in the folded position. As a result, the height of the foot part contributes only negligibly to the overall height of the folded workbench.

A development which has advantages particularly with respect to handling includes a support body that is extendable for purposes of height adjustment.

In another development of the invention, it is provided that the work component support bears two clamping jaws which can be displaced toward each other by pedal actuation. To realize this, foot pedals can be disposed at the support body, for example, with the aid of which a displaceable clamping jaw can be moved against a fixed jaw by means of a Bowden cable or the like.

The inventive workbench is given greater stability by first and second connecting rods which are led on either side of the short edge of the support box. Additional advantages are provided when the two connecting rods that are allocated to respective legs are coupled together, for instance, by means of an axle body which is held in the two connecting rods and which penetrates the support box.

Additional advantages are provided when the joints joining the two support arms to the short side of the support box, the joints joining the support box to the work component support, and the support arms engaging the guideway form a triangle in the unfolded position and lie on a line in the folded position.

As a result, a reliable supporting of the unfolded, horizontally extending work component support is provided via the support arms at the support box.

It is additionally proposed that the foot part form standing surfaces only with its ends, by virtue of its convex arc shape. It also proves expedient when one of the rounded standing surfaces forms a stand line in the folded position.

Finally, the inventive workbench is advantageously enhanced by a lamp which is held by an extension of the support body that protrudes beyond the plane of the work component support.

DETAILED DESCRIPTION OF THE INVENTION

The invention will now be described in detail with reference to the drawings, which represent several exemplifying embodiments.

Figure 1:
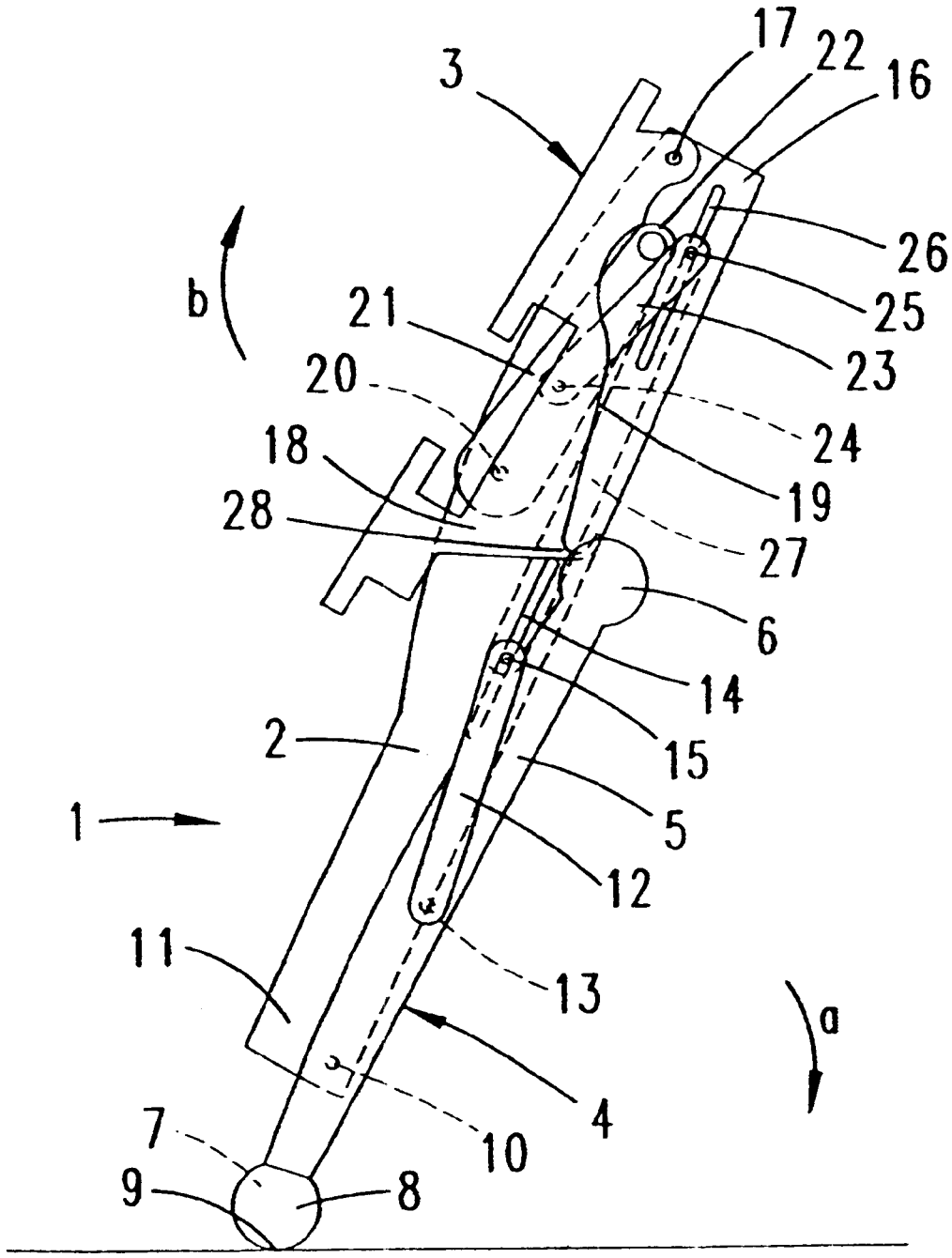
FIG. 1 is a schematic side view of an inventive workbench in the folded position, representing a first embodiment.

Referring to FIG. 1, a workbench 1 in a first embodiment is provided, having a support body 2 which is constructed as a four-sided closed torsion-resistant box, on one end of which a work component support 3 with clamping jaws is attached, and on the other end of which a foot part 4 is attached.

The foot part 4 has a substantially U-shaped contour with two freely projecting legs 5.

The free ends of the legs 5 of the foot part 4 are constructed as rounded standing surfaces 6. The crosspiece 7 connecting the legs 5 is likewise constructed as a rounded standing surface 8 over its entire length. In the folded position represented in FIG. 1, the rounded standing surface 8 forms a stand line. The stand line is referenced by the number 9 in FIG. 1.

The support body 2 is swivel-coupled with the foot part 4 by an axle 10 in the region of the U-opening of the foot part 4, i.e. between the legs 5 of the foot part 4. The axle 10 is positioned in a corner region of the foot end 11 of the support body 2.

A first connecting rod 12 is mounted at the foot part 4 approximately midway along the length thereof. An end of the first connecting rod 12 remote from the foot part bearing point 13 comprises a tab 15, which is led in a slot 14 of the support body 2. The slot 14 is constructed as a longitudinal slot along the length of the support body 2.

In the corner region of the end 16 of the support body 2, which is diagonally juxtaposed to the axle 10 of the foot part 4, the work component support 3 is mounted so as to swivel via an axle 17.

The work component support 3 comprises sidewalls 18 on either side of the support body 2. The bottom faces of the sidewalls 18 form guideways 19.

Between sidewall 18 and the allocated wall of the support body 2, a support arm 21 is mounted to the support body 2 so as to pivot about axle 20. The free end 22 of the support arm 21 comes into contact with the guideway 19 of the work component support 3 on the bottom side.

Also disposed with this support arm 21 is a second connecting rod 23, which pivots about an axle 24. The end of the rod 23 opposite the axle 24 is provided with a tab 25 which, like the first connecting rod 12 of the foot part 4, is led in a longitudinal slot 26 which extends linearly along the length of the support body 2.

For the synchronous displacement of the connecting rod tabs 15 and 25 in the slots 14 and 26, and the synchronous deflection of the connecting rods 12 and 23, these components are connected to each other. In the first represented exemplifying embodiment, this is accomplished with the aid of a coupling bar 27 which connects the tabs 15 and 25.

On either side of the support body 2 at its connecting rods 12 and 23 on the short side, allocated guide slots 14 and 26, as well as support arm 21, are provided.

In the folded position of the workbench represented in FIG. 1, the work component support 3, the support body 2, and the foot part 4 extend nearly parallel to one another, whereby the support body 2 submerges partly into the region of the work component support 3 and the region of the foot part 4. This produces a small structural height in the folded condition.

Furthermore, in this position, the support arm axle 20, the free end 22 of the support arm 21, which is in contact with the guideway 19, and the joint 17 lie substantially on a line.

Also, the folded position is stop-limited such that a stop projection 28 at the end of the guideway 19 of the work component support 3 comes into contact with the free ends of the foot part legs 5.

Figure 2:
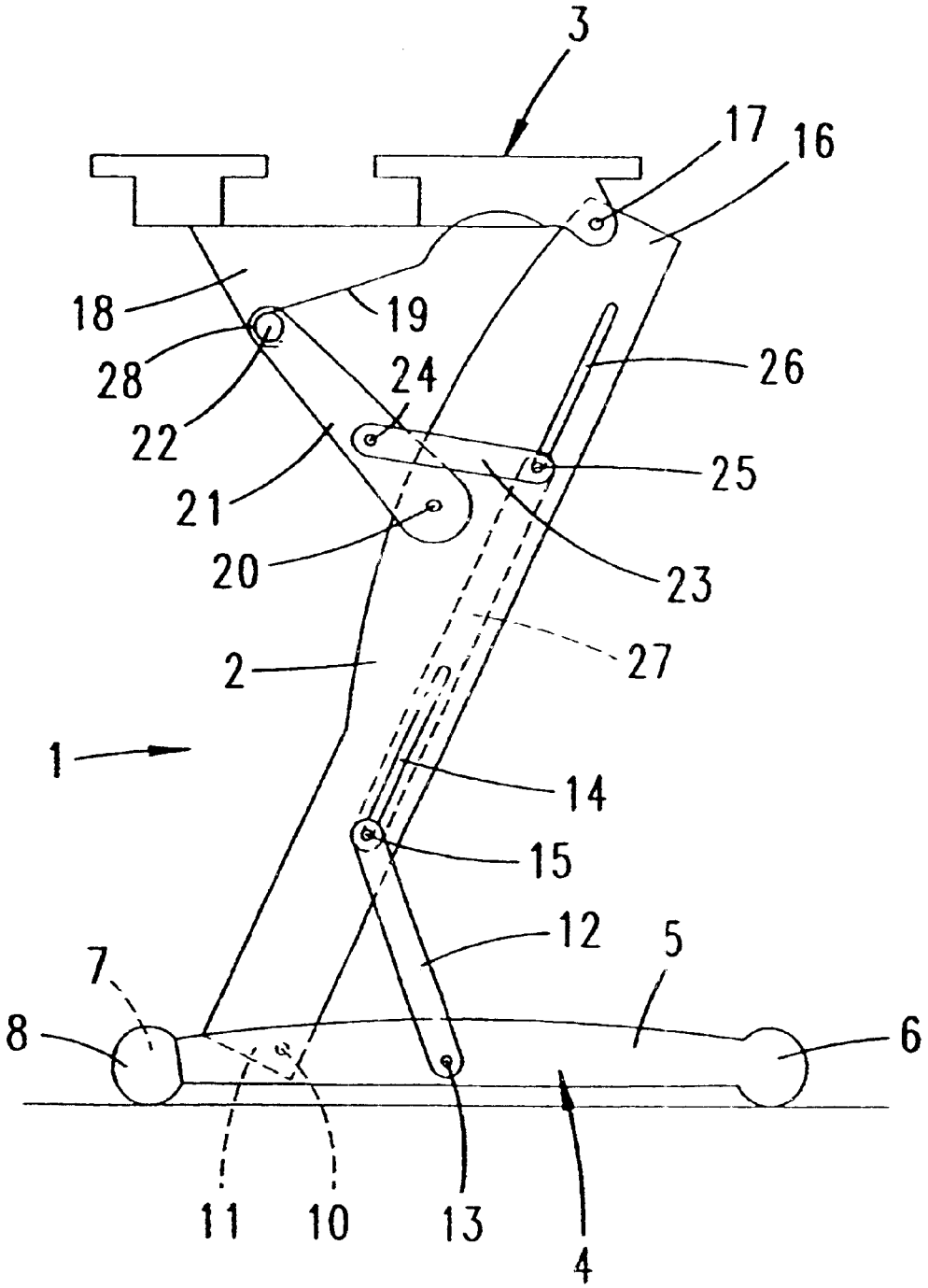
FIG. 2 shows the workbench represented in FIG. 1 in the unfolded position.
Figure 4:
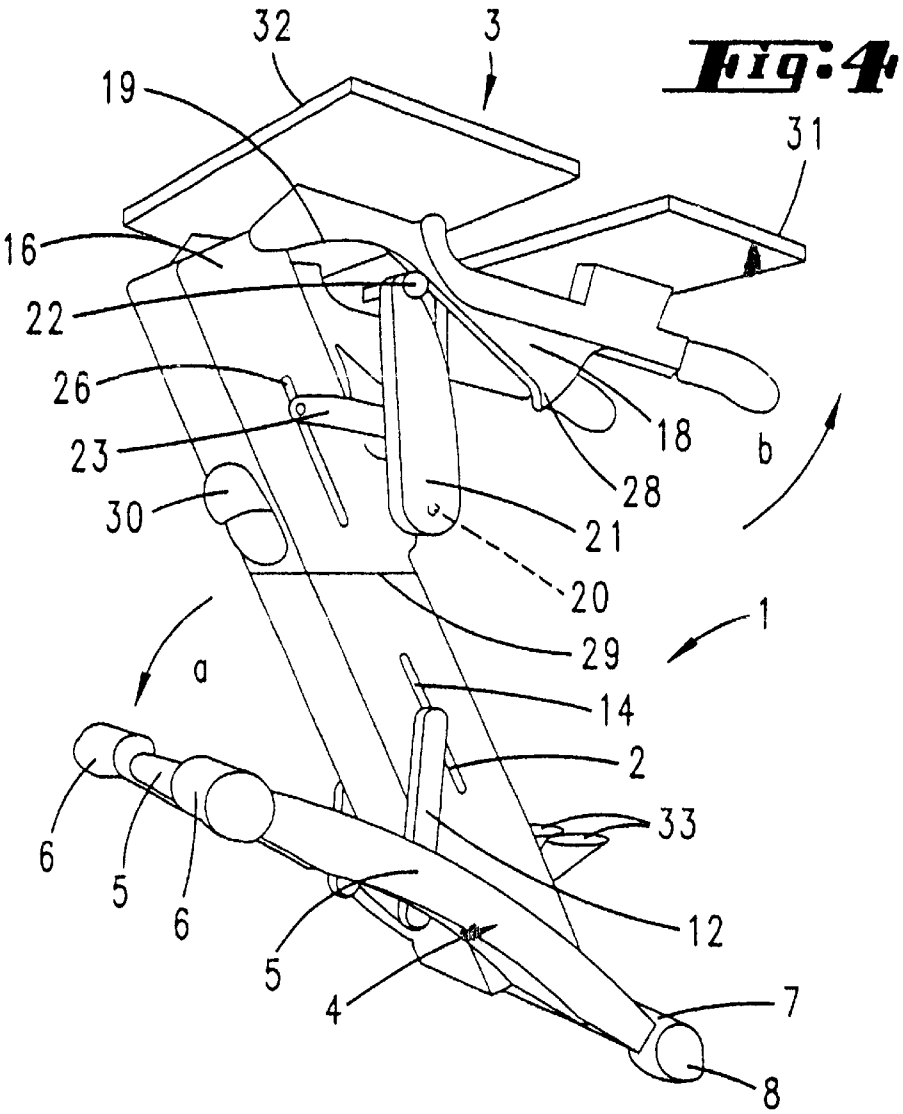
FIG. 4 shows the workbench represented in FIG. 3 in an intermediate position during the course of an unfolding maneuver.
Figure 3:
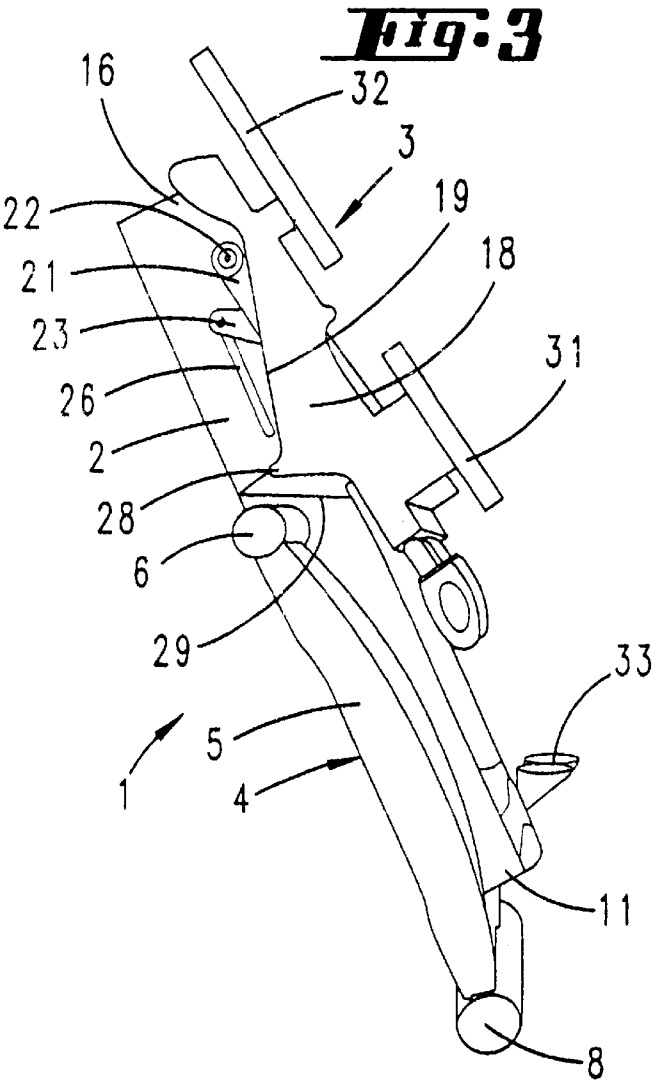
FIG. 3 is a schematic side view of a second embodiment of a workbench, representing the folded position.
Figure 6:
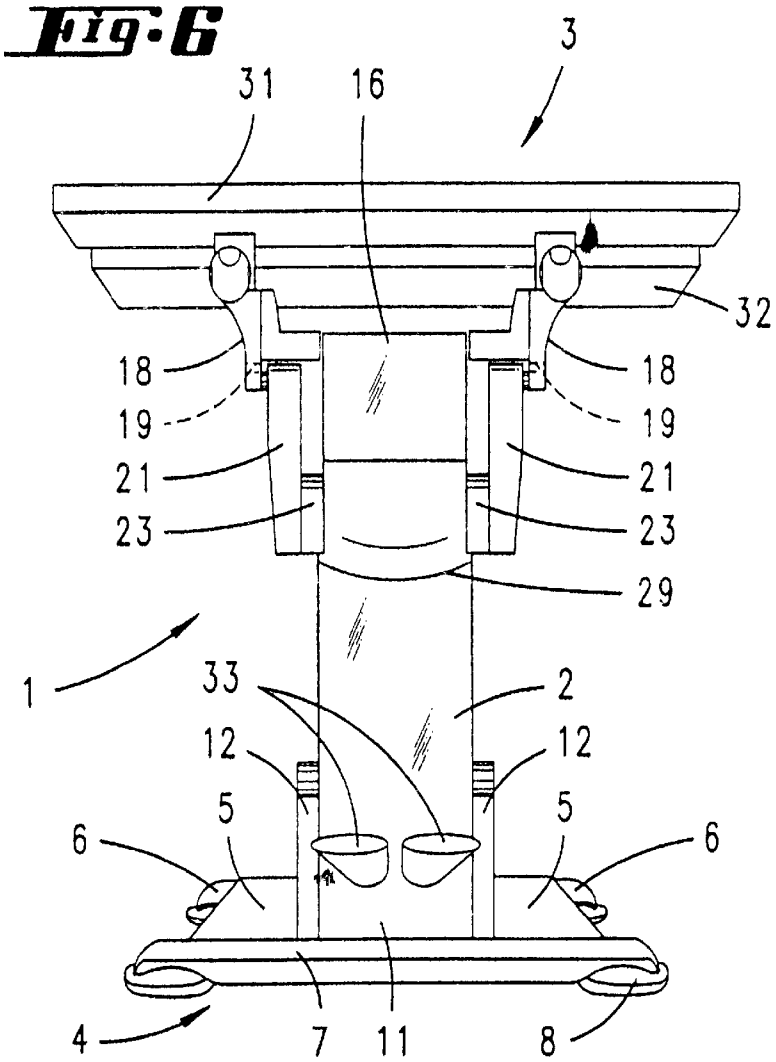
FIG. 6 shows the unfolded position of the workbench of FIG. 5 in a front view.
Figure 5:
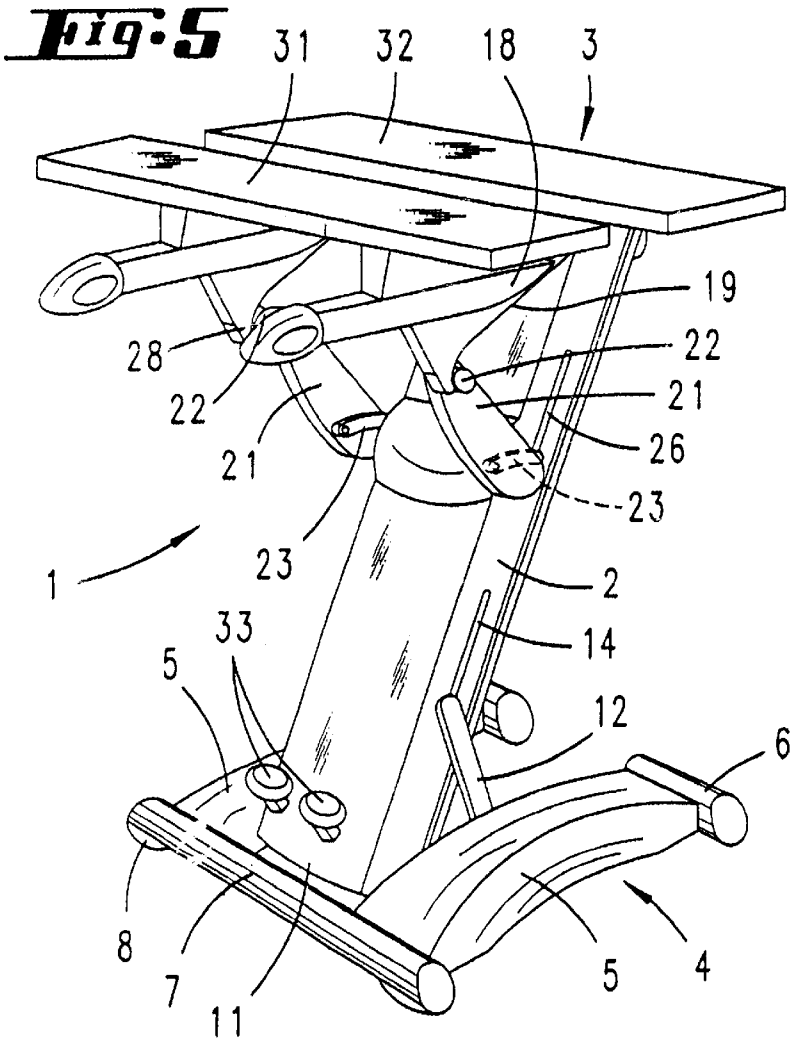
FIG. 5 shows the workbench of FIG. 3 in the unfolded position.

The set-up of the workbench 1 into the unfolded position represented in FIG. 2 is most easily accomplished by swiveling the free ends of the foot part legs 5 in the direction of arrow a. The first connecting rod 12, which is moved in this maneuver, consequently causes synchronous displacement of the second connecting rod 23 via the connecting bar 27. The support arm 21 is thus set up, whereby in the course of the swinging set-up maneuver, the end 22 at the guideway 19 running along the work component support 3 swings up in direction b. This set-up motion is limited by the contact of the support arm end 22 against the stop projection 8 at the end of the guideway 19. In this spread position represented in FIG. 2, both the work component support 3 and the foot part 4 are aligned horizontally. This position can also be locked.

Support body 2, work component support 3, and foot part 4 form a z shape, with the work component support 3 and the foot part 4 forming the legs of the z shape, and the support body 2 forming the diagonal.

In addition, the support arm axle 20, the free end 22 of the support arm 21, and the joint 17 of the work component support 3 at the support body 2 form a triangle.

FIGS. 3 to 6 represent a second exemplifying embodiment of the inventive workbench 1. This workbench 1 is identical to the above described exemplifying embodiment with respect to folding mechanics.

In this embodiment, for purposes of height adjustment the support body 2 is extendable, for which purpose the support body 2 is substantially divided in two longitudinally. The dividing plane is referenced by the number 29.

The height adjustment can be accomplished by means of a handle 30 for lifting a catch. The handle 30 is disposed on the back of the support body 2.

Furthermore, the foot part 4 (particularly, the foot part legs 5) has a convex arc shape, whereby only the ends of the foot part 4 form standing surfaces 6, 8.

Advantageously, a displacement of clamping jaws 31, 32 which are disposed at the work component support 3 is accomplished by actuation of pedals 33. A Bowden cable can be provided to accomplish this. By foot actuation, the clamping jaw 31 is moved against the fixed clamping jaw 32. But, a construction in which the clamping jaws 31 and 32 are moved equal distances toward each other is also possible.

Figure 7:
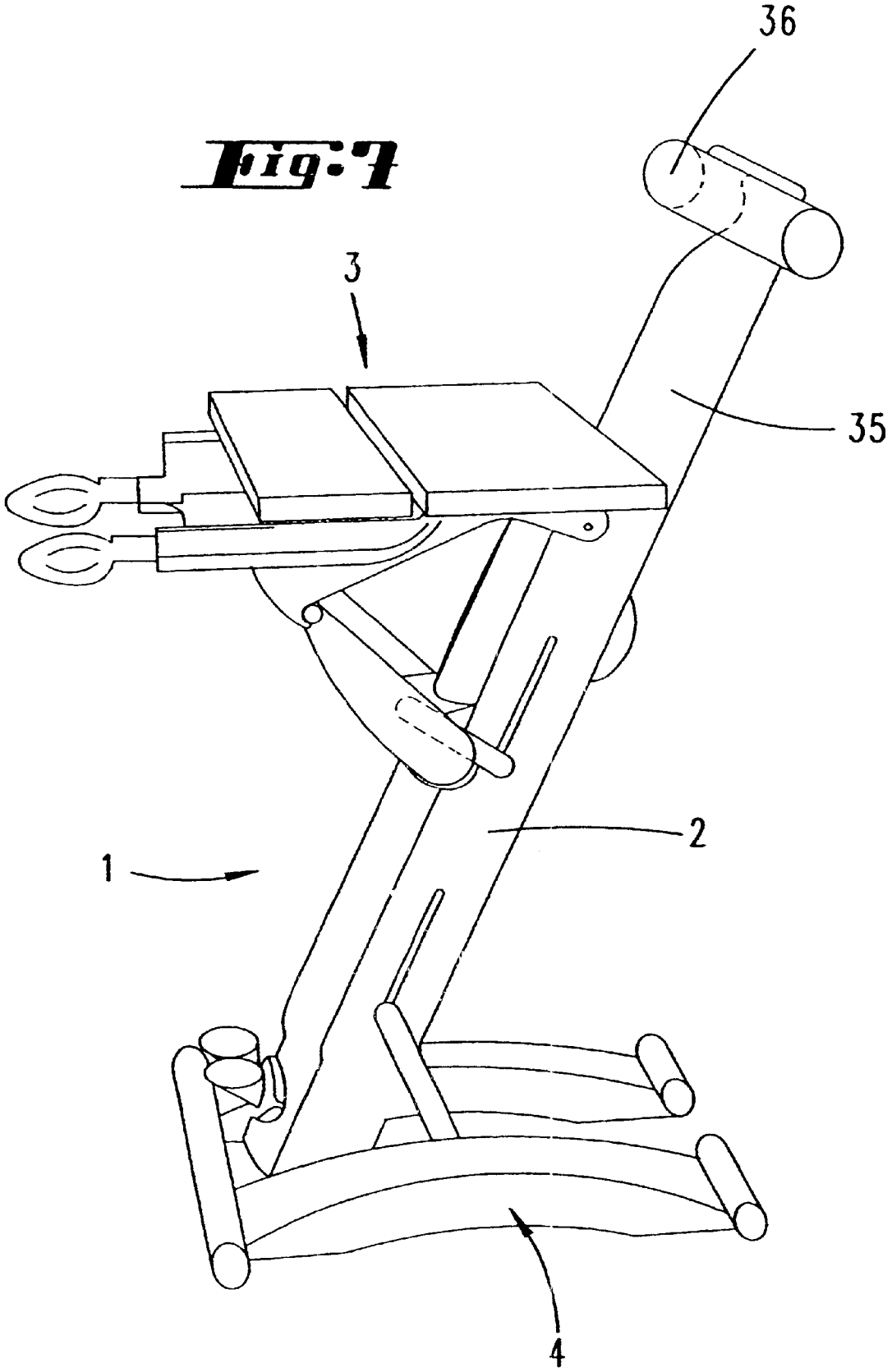
FIG. 7 shows the workbench in a third embodiment.

For illuminating the work area, the workbench 1 represented in FIG. 7 is provided with a lamp 36, which is disposed at the free end of an extension 35 of the support body 2 projecting beyond the work component support 3.

What is claimed is:

1. A workbench, comprising:

a work component support;

a foot part;

a support body having a foot end connected to the foot part and another end diagonally juxtaposed the foot end and connected to the work component support and forming a z-shape; and a first connecting rod engaged with the foot part and slideable in a slot of the support body;

wherein the foot part and the work component support are foldable into a position parallel to the support body in synchronized fashion.

2. The workbench as claimed in claim 1, further comprising a second connecting rod, engaged with a pivoting support arm disposed on the support body and slideable in another slot of the support body synchronously with the first connecting rod.

3. The workbench as claimed in claim 2, wherein the first and second connecting rods are led on either side of a short side of a support box defined by the support body.

4. The workbench as claimed in claim 2, wherein the support arm which is joined to support the body, a joint joining the support body to the work component support, and a portion of the support arm which engages a guideway of the work component support form a triangle in the unfolded position, and stand substantially on a line in the folded position.

5. The workbench as claimed in claim 2, wherein the first and second connecting rods are connected to each other.

6. The workbench as claimed in claim 1, wherein during folding of the bench an end of a support arm opposite a joint with the support body slides along a guideway of the work component support.

7. The workbench as claimed in any one of the claims 1–6, wherein the support body is constructed as a four-sided, closed torsion-resistant box.

8. The workbench as claimed in any one of claims 1–6, wherein the foot part is bipartite, and the two parts are situated next to the support body in the folded position.

9. The workbench as claimed in any one of claims 1–6, wherein the support body is extendable for purposes of adjusting the height.

10. The workbench as claimed in any one of claims 1–6, wherein the work component support comprises clamping jaws, which can be moved toward each other by actuating a pedal.

11. The workbench as claimed in any one of claims 1–6, further comprising a lamp supported by an extension of the support body which protrudes beyond the work component support.

12. The workbench as claimed in any one of the claims 1–6, wherein the work component support comprises one of the clamping jaws or a work top.

13. The workbench as claimed in any one of claims 1–6, wherein the foot part has a convex arc shape and standing surfaces only at its ends.

14. The workbench as claimed in claim 13, wherein one of the standing surfaces forms a standing line in the folded position.

* * * * *